United States Patent [19]

Ohashi et al.

[11] Patent Number: 4,992,234

[45] Date of Patent: Feb. 12, 1991

[54] METHOD FOR THE PREPARATION OF RARE EARTH-BASE PERMANENT MAGNET

[75] Inventors: Ken Ohashi; Masanobu Shimao, both of Fukui, Japan

[73] Assignee: Shin-Etsu Chemical Co., Ltd., Tokyo, Japan

[21] Appl. No.: 556,254

[22] Filed: Jul. 19, 1990

[30] Foreign Application Priority Data

Jul. 24, 1989 [JP] Japan ..... 1-191169

[51] Int. Cl.[5] ..... B22F 3/00

[52] U.S. Cl. ..... 419/23; 419/29; 419/33; 419/38; 419/54; 419/12; 75/244; 252/62.55

[58] Field of Search ..... 419/23, 29, 33, 38, 419/54, 12; 75/244; 252/62.55

[56] References Cited

U.S. PATENT DOCUMENTS 4,601,875 7/1986 Yamamato et al. ..... 419/23

4,614,637 9/1986 Boncoeur et al. ..... 419/2

4,814,139 3/1989 Tokunaga et al. ..... 419/12

4,826,546 5/1989 Yamamoto et al. ..... 148/102

4,888,068 12/1989 Tokunaga et al. ..... 148/104

*Primary Examiner*—Stephen J. Lechert, Jr.

*Assistant Examiner*—Leon Nigohosian, Jr.

*Attorney, Agent, or Firm*—Wenderoth, Lind & Ponack

[57] ABSTRACT

An improved method is proposed for the preparation of a sintered permanent magnet of a rare earth-iron-boron alloy having remarkably improved magnetic properties and stability by the powder metallurgical process. The scope of the inventive method consists in the particle size classification of the alloy powder for compression molding into a powder compact to be sintered, by which particles having a finer particle diameter and, preferably, a coarser particle diameter than the respective critical values are removed so as to effectively prevent oxidation of the too fine particles and improving the magnetic orientation of the particles as well as the sintering behavior of the particles.

8 Claims, No Drawings

METHOD FOR THE PREPARATION OF RARE EARTH-BASE PERMANENT MAGNET

BACKGROUND OF THE INVENTION

The present invention relates to a method for the preparation of a permanent magnet of an intermetallic compound mainly composed of a rare earth element and iron by a powder metallurgical method. More particularly, the invention relates to a method for the preparation of an alloy-type permanent magnet mainly composed of a rare earth element, denoted by a symbol R hereinbelow, iron and boron having outstandingly high stability against otherwise possible changes in the magnetic properties in the lapse of years for service.

Rare earth-based permanent magnet of the ternary alloy or intermetallic compound consisting of a rare earth element (R), iron (Fe) and boron (B) is a recently developed and very promising permanent magnet material in respect of the outstandingly high magnetic properties even as compared with the rare earth-cobalt based pe-manent magnets so that intensive investigations are now under way to develop a method for the industrial production of the permanent magnets of this type. For example, Japanese Patent Kokai Nos. 59-46008, 59-64733 and 56-89401 reported that a permanent magnet of the chemical composition of the formula $Nd_{0.15}Fe_{0.77}B_{0.08}$ could have a maximum energy product $(BH)_{max}$ of as large as 35 MGOe and a coercive force ${}_iH_c$ of up to 10 kOe. It is taught that improvement in respect of the Curie temperature of the permanent magnet of this type can be obtained by replacing a part of the iron with cobalt Co. Further, it is taught that the coercive force ${}_iH_c$ can be increased by the addition of a small amount of one or more of the elements selected from the group consisting of aluminum, bismuth, zirconium, hafnium, vanadium, tungsten, molybdenum, chromium, tantalum, antimony, germanium, niobium, nickel, titanium, tin and the like. Reportedly, the permanent magnets of the R-Fe-B type manufactured in a mass production system may have a maximum energy product $(BH)_{max}$ of as large as 37 MGOe greatly exceeding the best value of 33 MGOe obtained with the rare earth-cobalt type permanent magnets. A problem in the R-Fe-B type permanent magents from the practical standpoint is that the magnets of this type are highly susceptible to oxidation in the atmospheric air so that, when the magnet is used as an element in electric or electronic instruments, the magnetic properties of the permanent magnet are gradually changed in the lapse of time to affect the performance of the instrument utilizing the permanent magnet in addition to the disadvantage that the temperature dependency of the magnets is considerably larger than in the rare earth-cobalt type permanent magnets.

In respect of the oxidation of the R-Fe-B alloys or, in particular, fine powders of such an alloy in the atmospheric air, it is a conventional practice that pulverization of the alloy ingot into powders is conducted in an atmosphere of non-oxidizing or inert gas such as nitrogen, argon and the like or in an organic solvent such as n-hexane and the like. The effectiveness of such an oxidation-preventing means is still insufficient so that oxidation of the alloy powder proceeds faster or slower throughout the processes of pulverization, transportation, storage and subsequent processing resulting in a decrease or poor reproducibility of the magnetic properties of the permanent magnets prepared from the alloy powder.

U.S. Pat. Nos. 4,597,938, 4,601,875 and 4,684,406 teach that R-Fe-B type permanent magnets with certain additive elements having improved magnetic properties can be prepared from a powder of the alloy as pulverized having an average particle size of 0.3 to 80 μm. The magnetic properties reported there, however, are still not quite satisfactory. For example, the highest value of the maximum energy product is 34.5 MGOe in the magnets prepared from the alloys of the chemical composition of the formulas 63Fe5Co12B18Nd2Ta and 64Fe8-Co10B16Nd2Mn. These magnets, however, are still poor in respect of the coercive force ${}_iH_c$ with a value of 8.6 kOe or 9.3 kOe, respectively. Although some improvements can be obtained in the coercive force to give a value of about 12 kOe, the improvement is obtained only at a considerable sacrifice of the maximum energy product.

SUMMARY OF THE INVENTION

The present invention accordingly has an object to provide a novel and improved method for the preparation of a R-Fe-B type permanent magnet from a magnetic alloy based on a rare earth element, iron and boron which is outstandingly free from the problems and disasdvantages of the oxidation of the alloy powder.

Thus, the method of the present invention for the preparation of a permanent magnet of a magnetic alloy comprising a rare earth element, iron and boron comprises the steps of:

(a) pulverizing an alloy having a chemical composition expressed by the formula $$R_xFe_{1-x-y-z}B_yM_z, \quad (I)$$

in which R is a rare earth element, M is an element selected from the group consisting of aluminum, cobalt, gallium, niobium and zirconium, the subscript x is a positive number in the range from 0.10 to 0.25, the subscript y is a positive number in the range from 0.01 to 0.20 and the subscript z is zero or a positive number not exceeding 0.20, into an alloy powder;

(b) removing particles having a diameter smaller than 2 μm from the alloy powder;

(c) shaping the alloy powder by molding into a green powder compact;

(d) heating the green powder compact to effect sintering at a temperature in the range from 1000° to 1200° C. into a sintered body; and (e) subjecting the sintered body to a heat treatment at a temperature not lower than 350° C. but lower by at least 50° C. than the temperature at which the green powder compact is sintered in step (c) for a length of time in the range from 30 minutes to 4 hours.

It is preferable that the alloy powder obtained in step (a) is freed from coarse particles having a diameter larger than 50 μm or, more preferably, than 20 μm prior to shaping in step (c).

DETAILED DESCRIPTION OF THE PREFERRED EMBODIMENTS

As is described above, the characteristic features of the inventive method consist in the specific chemical composition of the magnetic alloy, specific particle size distribution of the alloy powder to be shaped into a green powder compact and the specific temperature schedule for the heat treatment in the preparation of the sintered body from the alloy powder.

The chemical composition of the magnet alloy used in the inventive method is expressed by the formula $$R_xFe_{1-x-y-z}B_yM_z. \quad (I)$$

In the formula, R is a rare earth element selected from the group consisting of yttrium and the elements having an atomic number in the range from 57 to 71 inclusive. It is preferable that the rare earth element is entirely or mostly neodymium optionally in combination with terbium and/or dysprosium. Two kinds or more of these rare earth elements can be used in combination according to need. M in the formula, which is an optional constituent of the alloy, is an element selected from the group consisting of aluminum, cobalt, gallium, niobium and zirconium. Two kinds or more of these elements can be used in combination according to need. The subscripts x, y and z define the molar proportion of the elements including iron Fe, boron B and the elements denoted by R and M. Thus, x is a positive number in the range from 0.10 to 0.25 and y is a positive number in the range from 0.01 to 0.20. The subscript z is zero or a positive number not exceeding 0.20. When the chemical composition of the magnetic alloy is outside the range defined by these subscripts, the permanent magnet prepared from the alloy would have poor magnetic properties, in particular, in the residual magnetic flux density and coercive force even when the other requirements relative to the particle size distribution of the alloy powder and the temperature schedule for the heat treatment are satisfied.

When an ingot of the above described magnetic alloy is pulverized, the resultant alloy powder usually has a considerably broad particle size distribution including a substantial amount of extremely fine particles. Needless to say, the specific surface area of a powder rapidly increases as the particle size of the particles is decreased so that a magnetic alloy powder containing extremely fine particles are highly susceptible to the oxidation by the atmospheric oxygen. The inventors have directed their attention to this fact and arrived, after extensive investigations, at a discovery that the adverse influences due to the increased oxygen content in the alloy powder can be overcome when the alloy powder does not contain extremely fine particles thus to provide a possibility of improvement and/or stabilization of the magnetic properties of the permanent magnets prepared from the alloy powder. In particular, fine particles in a powder of neodymium-iron-boron magnet alloys are rapidly oxidized by the atmospheric oxygen already in the course of pulverization in a non-oxidizing atmosphere and there-after to greatly increase the oxygen content in the alloy powder obtained by pulverization of an ingot. When an alloy powder contains about 5% by weight of particles finer than 2 μm in the particle diameter, for example, about 15 to 20% of the overall surface area of the powder is occupied by these fine particles. Therefore, a great improvement could be obtained in the magnetic properties of the permanent magnets as a result of the decrease in the oxygen content of the alloy powder by removing these extremely fine particles from the powder with only a minor material loss. The advantage obtained by the elimination of fine particles from an alloy powder is particularly great when the rare earth element is neodymium and the alloy contains relatively small amounts of neodymium and boron such as the alloy expressed by the formula $Nd_{0.14}Fe_{0.80}B_{0.06}$.

On the other hand, the alloy powder as pulverized usually contains relatively coarse particles. It has also been established that such coarse particles in the alloy powder are responsible for the decrease in the density of the sintered body and in the degree of magnetic orientation of the particles in the sintered permanent magnet. For example, particles having a diameter larger than 50 μm are mostly not constituted of a single crystalline phase to cause a great decrease in the magnetic orientation of the particles in the powder compact in addition to the adverse influences on the densification of the sintered body. Thus, particles having a particle diameter finer than 2μm and particles having a particle diameter larger than 50 μm or, preferably, larger than 20 μm should be removed in step (b) from the alloy powder obtained in step (a).

Thus, the most characteristic feature in the inventive powder-metallurgical method consists in the use of a magnetic alloy powder from which particles having a diameter finer than 2 μm and, preferably, coarser than 50 μm have been removed.

The starting magnetic alloy in the form of an ingot can be prepared in a conventional procedure. Thus, each of the constituent elements in the metallic form is taken by weighing and they are melted together in vacuum or under an atmosphere of argon gas, preferably, in a high-frequency induction furnace. The boron constituent can be introduced in the form of a ferroboron if the impurity content in the ferroboron is not unduly high. It is preferable that the rare earth element is added to the melt of the other elements formed in advance. After establishment of the uniformity in the melt of the elements, the melt is poured into a mold and solidified there by cooling into an ingot.

The magnetic alloy in the form of an ingot is then pulverized into an alloy powder. It is usual that the process of pulverization of an alloy ingot is conducted in two steps including rough pulverization and fine pulverization. The rough pulverization can be conducted by using various types of pulverizing machines including stamp mills, jaw crushers, Braun mills and the like while the machine suitable for fine pulverization includes jet mills, ball mills and the like. At any rate, it is essential that the alloy under pulverization is strictly prevented against oxidation by the atmospheric oxygen by conducting the pulverization in an atmosphere of a non-oxidizing or inert gas such as nitrogen, argon and the like. Sometimes, an organic solvent such as n-hexane is used as the medium for the pulverization in a wet process.

The alloy powder obtained in the above described pulverization as the step (a) usually has a particle diameter distribution in the range from 0.1 μm to 100 μm so that the alloy powder as pulverized cannot be used as such as a material for the preparation of sintered permanent magnets. The alloy powder as pulverized should preferably have an average particle diameter in the range from 3 μm to 10 μm and contain at least 90% by volume of particles having a particle diameter in the range from a value smaller than the average diameter by 2 μm or less to a value larger than the average diameter by 10 μm or less. The alloy powder then must be subjected to a particle size classification treatment by a suitable method in order to remove particles having a particle diameter finer than 2 μm and, preferably, coarser than 50 μm. Applicable methods for the particle size classification include those utilizing screens of an appropriate mesh opening, rotative force, air stream and the like as well as a combination of these different principles. It should be noted that, as an inherent nature of magnetic particles, very fine particle sometimes form agglomerates by the attracting magnetic force of each of the particles so that great difficulties are encountered in the particle size classification of the alloy powder undertaken according to a known method after the fine pulverization.

In this regard, best results can be obtained by using a particle-size classifier machine utilizing a combination of a rotative force and air stream. This machine is provided with a mechanism for dispersing the alloy particles as fed in the circumferential direction by means of the centrifugal force utilizing radially arranged dispersing channels, dispersing blades or dispersing boards and a mechanism for dispersing the particles by passing the powder through a narrow gap between a dispersing disc and the casing. In this machine, each particle is subjected to the centrifugal force by the rotation of the machine and the reactive force by the air stream so that too coarse particles are struck out from the body of the powder by the centrifugal force while too fine particles are separated from the body of the powder by means of the reactive force of the air stream. The critical points for the particle size classification can be adjusted by controlling the flow rate of the air stream through the classifying chamber and the rotating velocity of the dispersing disc. It is of course that control of these parameters is performed for each of the upper and lower limits of the particle size distribution which the alloy powder should have after the particle size classification. Several models of particle size classifying machines working in the above described principle are commercially available.

The alloy powder after the particle size classification is inspected to ensure substantial absence of fine particles having a diameter smaller than 2 μm. A quite satisfactory and reliable results can be obtained in the determination of the particle size distribution by the laser beam scanning method in which a thin layer of a mull of the alloy powder in an epoxy resin on a glass plate is scanned with a laser beam and the signals caused in the interception of the laser beam by the particles are subjected to a computerized processing to calculate the particle size distribution. Several models of indtruments for the determination of particle size distribution working in the above described principle are commercially available. It is important that the volume fraction of the fine particles having a diameter smaller than 2 μm in the alloy powder after the particle size classification does not exceed 1% or, preferably, 0.5%.

The magnetic alloy powder obtained in the above described manner, from which too fine and, optionally, too coarse particles have been removed in step (b), is then shaped in step (c) into a green powder compact by compression molding in a metal mold. The conditions of the compression molding can be conventional. The compression molding is performed in a magnetic field in order to magnetically orient the alloy particles.

The green powder compact is then subjected to sintering in step (d) by heating at a temperature in the range from 1000 to 1200° C. for a length of time of 30 to 120 minutes in vacuum or in an atmosphere of a non-oxidizing or inert gas such as nitrogen, argon and the like. The length of time for the sintering treatment naturally depends on the sintering temperature so that the correlation between these two parameters should be established beforehand by conducting preliminary experiments within the above mentioned ranges. When sintering is effected insufficiently, the sintered body would be poor in the mechanical strengths required for a permanent magnet. When sintering is conducted overly, on the other hand, an excessive growth may be caused in the particles forming the principal phase or coalescence of the particles may take place by partial melting.

The sintered body is then subjected to an aging treatment by keeping at a temperature not lower than 350° C. but lower by at least 50° C. than the sintering temperature for a length of time in the range from 30 minutes to 4 hours followed by rapid cooling to room temperature. When this heat treatment of the sintered body is conducted only insufficiently, the permanent magnet thus obtained cannot exhibit a coercive force as high as desired. When the heat treatment is performed overly, on the other hand, overgrowth of the particles may take place to decrease the coercive force of the permanent magnet obtained thereby.

In the following, the method of the present invention is described in more detail by way of examples and comparative examples although the scope of the invention is never limited thereby. In the following description, the term of "parts" always refers to "parts by weight" if not otherwise mentioned.

EXAMPLE 1.

The starting materials used included neodymium metal having a purity of at least 99.7%, electrolytic iron having a purity of at least 99.9% and a ferroboron alloy containing 19.4% of boron, the balance being iron and small amounts of aluminum, silicon, carbon and the like as impurities. They were each taken in a calculated amount and melted together in a high-frequency induction furnace and an ingot was obtained by casting the melt into a coppermade mold. The ingot has a chemical composition expressed by the formula $Nd_{0.15}Fe_{0.77}B_{0.08}$ according to the results of the chemical analysis. The ingot was crushed and roughly pulverized by using a jaw crusher and a Braun mill into a coarse powder having a particle size distribution to pass a screen of 32 mesh opening. The coarse powder was then finely pulverized in a jet mill with a jet stream of nitrogen gas into a fine powder having an average particle diameter of about 3 μm.

The alloy powder was examined by the laser beam scanning method for the particle size distribution to find that the content of the particles having a particle diameter of 2 μm or smaller was about 5% by volume with substantial absence of coarse particles having a diameter larger than 50 μm. This alloy powder was dispersed using a dispersing machine utilizing the ejector effect and classified relative to the particle size distribution into two fractions of coarser and finer particles at 2 μm as the critical point in an air-stream particle size classifier into which the alloy powder after dispersion in the ejector machine was introduced while the classifier plate was under rotation using nitrogen as the carrier gas. The thus obtained coarser fraction of the powder contained only about 0.1% by volume of the particles finer than 2 μm in diameter as determined by the same method as mentioned above.

The thus obtained alloy powder after particle size classification to remove too fine particles was compression-molded in a metal mold under a pressure of 1.5 tons/cm$^2$ in a magnetic field of 10 kOe to give a green powder compact which was sintered by heating at 1060° C. for 1 hour followed by aging first at 900° C. for 1 hour and then at 550° C. for additional 1 hour in a high-frequency induction furnace in an atmosphere of argon to give a sintered magnet body which was examined for the oxygen content and the magnetic properties to give the results shown in Table 1 given below.

COMPARATIVE EXAMPLES 1 AND 2.

The process for the preparation of the sintered magnet bodies in each of these comparative examples was just the same as in Example 1 described above except that the alloy powder subjected to compression molding was either the powder as pulverized before particle size classification or the fraction of the finer particles having a particle diameter smaller than 2 μm as obtained by the particle size classification, respectively. Table 1 also shows the oxygen contents and the magnetic properties of the thus obtained sintered permanent magnets.

EXAMPLE 2.

The procedure was just the same as in Example 1 except that the rare earth-based alloy had a chemical composition of the formula $Nd_{0.142}Dy_{0.004}Fe_{0.741}B_{0.061}Co_{0.039}Al_{0.012}Nb_{0.001}$ as prepared from the starting materials of the respective metals including, besides the same neodymium metal, electrolytic iron and ferroboron as used in Example 1, cobalt metal having a purity of 99.5%, dysprosium metal having a purity of at least 99.7% and aluminum and niobium metals each having a purity of at least 99.5%. The powder as pulverized contained about 5% by volume of fine particles having a particle diameter of 2 μm or finer while the content of these fine particles could be reduced to about 0.1% by volume after the procedure of particle size classification.

Table 1 below shows the oxygen content and the magnetic properties of the thus prepared sintered permanent magnet.

COMPARATIVE EXAMPLES 3 AND 4.

The process for the preparation of the sintered magnet bodies in each of these comparative examples was just the same as in Example 2 described above except that the alloy powder subjected to compression molding was either the powder as pulverized before particle size classification or the fraction of the finer particles having a particle diameter smaller than 2 μm as obtained by the particle size classification, respectively. Table 1 also shows the oxygen contents and the magnetic properties of the thus obtained sintered permanent magnets. Comparison of the results obtained in Comparative Example 3 with those obtained in Example 2 gives a conclusion that substnatial improvements can be obtained in the coercive force and maximum energy product of the permanent magnets by removing the fine particles from the alloy powder.

EXAMPLE 3.

An ingot of the same alloy as prepared in Example 2 was crushed and roughly pulverized to have a particle size distribution passing through a screen of 32 mesh opening by using a jaw crusher and a Braun mill and then finely pulverized using a jet mill in a jet stream of nitrogen. The thus obtained alloy powder having an average particle diameter of about 3 μm contained about 5% by volume of fine particles having a particle diameter smaller than 2 μm and about 8% by volume of coarse particles having a particle diameter larger than 20 μm.

The alloy powder was subjected twice to the treatment of particle size classification in the same manner as in Example 1 firstly to remove the fine particles smaller than 2 μm and secondly to remove the coarse particles larger than 20 μm from the coarser fraction obtained in the first classification treatment. The thus obtained powder fraction of the intermediate particle size distribution contained only about 0.1% by volume of the particles finer than 2 μm in diameter and less than 0.5% by volume of the particles coarser than 20 μm in diameter.

The alloy powder was processed into a sintered permanent magnet in the same manner as in Example 1. Table 1 below also shows the oxygen content and the magnetic propertties of the thus prepared permanent magnet. The "squareness ratio" given in the table is a value of the magnetic field in Oe corresponding to 90% of the residual magnetic flux density in the second quadrant of the magnetic hysteresis loop divided by the coercive force given in Oe. This value is an important parameter for the evaluation of the performance of a permanent magnet built in a magnetic circuit.

TABLE 1

| | Oxygen content, % | Residual magnetization $B_4$,kG | Coercive force $_iH_c$, kOe | Maximum energy product $(BH)_{max}$, MGOe | Squareness ratio |
|---|---|---|---|---|---|
| Example | | | | | |
| 1 | 0.304 | 12.71 | 10.96 | 35.6 | — |
| 2 | 0.341 | 12.60 | 13.52 | 37.2 | — |
| 3 | 0.303 | 12.80 | 13.52 | 38.8 | 0.991 |
| Comparative Example | | | | | |
| 1 | 0.484 | 12.35 | 9.74 | 34.2 | — |
| 2 | 0.971 | ca.0 | ca.0 | ca.0 | — |
| 3 | 0.546 | 12.12 | 12.05 | 33.5 | 0.913 |
| 4 | 1.050 | ca.0 | ca.0 | ca.0 | — |

What is claimed is:

1. A method for the preparation of a permanent magnet of a magnetic alloy comprising a rare earth element, iron and boron which comprises the steps of:

(a) pulverizing an alloy having a chemical composition expressed by the formula $$R_xFe_{1-x-y-z}B_yM_z,$$

in which R is a rare earth element, M is an element selected from the group consisting of aluminum, cobalt, gallium, niobium and zirconium, the subscript x is a positive number in the range from 0.10 to 0.25, the subscript y is a positive number in the range from 0.01 to 0.20 and the subscript z is zero or a positive number not exceeding 0.20, into an alloy powder;

(b) removing particles having a diameter smaller than 2 μm from the alloy powder;

(c) shaping the alloy powder by molding into a green powder compact;

(d) heating the green powder compact to effect sintering at a temperature in the range from 1000° to 1200° C. into a sintered body; and (e) subjecting the sintered body to a heat treatment at a temperature not lower than 350° C. but lower by at least 50° C. than the temperature at which the green powder compact is sintered in step (c) for a length of time in the range from 30 minutes to 4 hours.

2. The method for the preparation of a permanent magnet of a magnetic alloy as claimed in claim 1 wherein the rare earth element is neodymium.

3. The method for the preparation of a permanent magnet of a magnetic alloy as claimed in claim 1 wherein the rare earth element is a combination of neodymium and dysprosium.

4. The method for the preparation of a permanent magnet of a magnetic alloy as claimed in claim 1 wherein the alloy powder is freed from particles having a diameter smaller than 2 μm and particles having a diameter larger than 50 μm in step (b).

5. The method for the preparation of a permanent magnet of a magnetic alloy as claimed in claim 4 wherein the alloy powder is freed from particles having a diameter smaller than 2 μm and particles having a diameter larger than 20 μm in step (b).

6. The method for the preparation of a perparation of a permanent magnet of a magnetic alloy as claimed in claim 1 wherein the alloy powder after step (b) contains particles having a particle diameter smaller than 2 μm in a volume fraction not exceeding 1%.

7. The method for the preparation of a permanent magnet of a magnetic alloy as claimed in claim 6 wherein the alloy powder after step (b) contains particles having a particle diameter smaller than 2 μm in a volume fraction not exceeding 0.5%.

8. The method for the preparation of a permanent magnet of a magnetic alloy as claimed in claim 1 wherein the element denoted by M is selected from the group consisting of cobalt, aluminum and niobium.

* * * * *